US006793302B2

(12) United States Patent
Russ

(10) Patent No.: US 6,793,302 B2
(45) Date of Patent: Sep. 21, 2004

(54) IN-LINE MARKING SYSTEM

(75) Inventor: Wray Russ, Brentwood, CA (US)

(73) Assignee: Microboards Technology, LLC, Chanhassen, MN (US)

( * ) Notice: Subject to any disclaimer, the term of this patent is extended or adjusted under 35 U.S.C. 154(b) by 0 days.

(21) Appl. No.: 10/105,030

(22) Filed: Mar. 22, 2002

(65) Prior Publication Data

US 2003/0179271 A1 Sep. 25, 2003

(51) Int. Cl.[7] ..... B41J 3/407; B41F 17/00
(52) U.S. Cl. ..... 347/4; 347/104
(58) Field of Search ..... 347/2, 4, 9, 10, 347/14, 16, 19, 104; 346/137; 101/36, 37, 43, 44, 118, 129

(56) References Cited

U.S. PATENT DOCUMENTS

| | | | | |
|---|---|---|---|---|
| 2,296,013 | A | | 9/1942 | Bell |
| 2,304,437 | A | | 12/1942 | Bell |
| 4,195,961 | A | | 4/1980 | Waiblinger |
| 4,504,186 | A | | 3/1985 | Richards |
| 4,595,481 | A | | 6/1986 | Allen et al. |
| 4,735,540 | A | | 4/1988 | Allen et al. |
| 4,921,397 | A | | 5/1990 | Watanabe |
| 5,123,005 | A | | 6/1992 | Kurosu |
| 5,210,729 | A | | 5/1993 | Schmidt et al. |
| 5,317,337 | A | | 5/1994 | Ewaldt |
| 5,322,188 | A | | 6/1994 | Dodaro |
| 5,397,214 | A | | 3/1995 | Cheung |
| 5,520,106 | A | | 5/1996 | Karlyn et al. |
| 5,520,107 | A | | 5/1996 | Airoldi |
| 5,537,376 | A | | 7/1996 | Ikuma |
| 5,721,715 | A | | 2/1998 | Mitani et al. |
| 5,734,629 | A | | 3/1998 | Lee et al. |
| 5,822,162 | A | | 10/1998 | Tannert |
| 5,846,005 | A | | 12/1998 | Britz et al. |
| 5,857,710 | A | | 1/1999 | Leising et al. |
| 5,865,114 | A | | 2/1999 | Averill et al. |
| 5,914,918 | A | | 6/1999 | Lee et al. |
| 5,927,208 | A | | 7/1999 | Hagstrom et al. |
| 5,984,295 | A | | 11/1999 | Britz |
| 6,075,758 | A | | 6/2000 | Wu |
| 6,123,020 | A | | 9/2000 | Wolfer et al. |
| 6,134,213 | A | | 10/2000 | Suzuki et al. |
| 6,135,316 | A | | 10/2000 | Wolfer et al. |
| 6,147,960 | A | | 11/2000 | Wolfer et al. |
| 6,148,722 | A | | 11/2000 | Hagstrom |
| 6,213,457 | B1 | * | 4/2001 | Schlough ..... 270/58.23 |
| 6,302,601 | B1 | | 10/2001 | Hagstrom et al. ..... 400/283 |
| 6,332,680 | B1 | * | 12/2001 | Ozawa ..... 347/104 |
| 6,354,502 | B1 | | 3/2002 | Hagstrom et al. ..... 235/462.04 |
| 6,447,181 | B1 | | 9/2002 | Hagstrom et al. ..... 400/120.1 |
| 2002/0021921 | A1 | | 2/2002 | Akema et al. |
| 2002/0092735 | A1 | | 7/2002 | Greive et al. |

FOREIGN PATENT DOCUMENTS

| | | |
|---|---|---|
| EP | 0 799 710 | 10/1997 |

OTHER PUBLICATIONS

EMEDIA Professional, "Buyers Guide to CD Duplication Systems—40 New towers, autoloaders, jukeboxes", Nov. 1997.

* cited by examiner

*Primary Examiner*—Thinh Nguyen
*Assistant Examiner*—Julian D. Huffman
(74) *Attorney, Agent, or Firm*—Burns, Doane, Swecker & Mathis, LLP

(57) ABSTRACT

An in-line marking system for marking indicia on a markable medium. The system includes a dispenser for dispensing a markable medium onto a conveyor belt assembly. The medium passes from a first position to a second position, wherein a marking device located between the first position and the second position marks indicia on the medium. The conveyor belt has a plurality of pockets for accepting the medium.

37 Claims, 9 Drawing Sheets

IN-LINE MARKING SYSTEM

FIELD OF THE INVENTION

The invention generally relates to a marking system and method for marking indicia on a markable medium, and more particularly to an in-line marking system for marking indicia on mediums such as compact disks, DVD's, computer chips, or any medium having a markable or printable surface.

BACKGROUND OF THE INVENTION AND BRIEF DESCRIPTION OF THE RELATED ART

The marking of mediums reflects the content of the medium and allows the dissemination of information wherein the end user can identify the subject matter located within the medium. In addition, logos, trademarks, text, graphics, and bar codes can be added to the medium for marketing, sales and cataloging of information.

The printing processes for printing information and graphics on the surface of a medium including plastic disks or compact disks, generally include a silk screening printing process, a printer utilizing ink jet printing technology, a labeling process or a thermal printing process. However, in any printing process, it is desirable that the pressure against the medium be uniformly applied during the printing process in order to insure the highest quality of printing onto the medium.

One of the most popular types of media is optical disks, such as compact disks and digital video disks, or digital versatile disks. The optical disk or CD has recently become a popular form of media for storing digital information, recording high quality audio and video information and also for recording computer software of various types. With advances in technology, it is now possible not only to read information from such optical media, but also to record digital information directly onto the media. For example, recordable compact disks (referred to as CD-Rs) may have digital information recorded on them by placing the CD-R into a compact disk recorder that receives the digital information from a computer. Such forms of optical media are thus particularly useful for data distribution and/or archiving.

Compact disks are standardized in two sizes and configurations, one having an overall diameter of 4.72 inches, a central hole of 0.59 inches, and a central region about the center hole of 1.50 inches in diameter, wherein no information is either printed or recorded. The other standard disk size is 3.5 inches in overall diameter, with a comparable central hole size and central region. In the case of disks for utilization in connection with computer processors, the recording formats and content are typically adapted to the particular generalized type of computer processor with which the disk is to operate. Some compact disks are recorded in such a way as to be usable with several different computer processor types; i.e., PC, Macintosh, etc.

The significant increases in use of CD disk and CD-R disks as a data distribution vehicle has increased the need to provide customized CD label content to reflect the data content of the disk. Initially, the customized label information was "hand written" on the disk surface using felt tipped markers. While this approach permitted users to individually identify disks, it tends to be labor intensive, prone to human error in transcription, and aesthetically limited.

Other attempts to provide a CD or CD-R labeling solution have incorporated digitally printed adhesive labels. Precut labels are printed using desktop or commercial inkjet, thermal wax transfer, or printers. An example of such labels is the STOMP Company's (Irvine, Calif.) CD Stomper package of die-cut CD labels that can be printed on any 8.5 by 11 inch ink jet or laser electrophotographic printer. Following printing, the labels can be applied manually with or without the aid of an alignment tool or a specially designed machine. This method can be labor intensive, and the CD-R can be damaged if the label is removed. In addition, system performance problems can occur due to disk imbalance or label de-lamination in the CD writer or reader.

Within the past several years, however, methods for direct CD labeling have been growing in prominence. These methods utilize the versatility and ease of the setup associated with digital printing to provide customized label content directly on a disk surface. The most commonly used direct CD printers incorporate ink jet or thermal wax transfer technologies. These printers can either stand alone or be integrated into a computerized disk writing system reducing problems associated with labor, human error, disk damage, and imbalance.

CDs are often coated with a printable surface opposite to the surface from which the information is recorded and retrieved. On the printable surface, a label is printed which can be logos, trademarks, text, graphics, and bar codes, etc., which are related to the information stored on the CD. The label also protects the CD from physical damage. Because the CD spins at high speed in the writer and the player, the CD label needs to be precisely balanced to the center of the disk for smooth rotation.

Labeling of CD disks has routinely been accomplished through screen printing methods. While this method can provide a wide variety of label content, it tends to be cost ineffective for run lengths less than 300–400 disks because the fixed cost on unique materials and set-up are shared by all the disks in each run. The screen printing technique is well described in the textbook "Graphic Arts Manual", edited by Janet and Irving Field, Arno/Musarts Press, New York, N.Y., 1980, pp. 416 to 418. In screen printing a stencil of the image is prepared, placed in contact with the CD and then ink is spread by squeegee across the stencil surface. Where there are openings in the stencil the ink passes through to the surface of the CD, thus producing the image. Preparation of the stencil is an elaborate, time consuming and expensive process.

Accordingly, what is desired is an in-line marking system having a marking device which can mark indicia on a large number of mediums including compact disks in an efficient and expedient manner.

SUMMARY OF THE INVENTION

In accordance with one aspect of the present invention, an in-line marking system includes a dispenser for dispensing a markable medium; a conveyor belt assembly for receiving the medium and passing the medium from a first position to a second position, the conveyor belt having a plurality of pockets for accepting the medium; and a marking device located between the first position and the second position for marking indicia on the medium.

In accordance with one aspect of the present invention, an in-line marking system includes a conveyor belt assembly for receiving a markable medium and passing the medium from a first position to a second position, the conveyor belt assembly having a plurality of pockets for accepting the medium; a marking device located between the first position and the second position for marking indicia on the medium received on the conveyer belt; and a receptacle for accepting the medium.

In accordance with another aspect of the present invention, a disk transfer system includes a disk dispenser for dispensing disks; a conveyor belt assembly for receiving a disk and passing the disk from a first position to a second position, the conveyor belt assembly having a plurality of pockets for accepting a disk; and a marking device located between the first position and the second position for marking indicia on the disk.

In accordance with a further aspect of the present invention, a disk transfer system includes a conveyor belt assembly for receiving a disk and passing a disk from a first position to a second position, the conveyor belt assembly having a plurality of pockets for accepting a disk; a marking device located between the first position and the second position for marking indicia on the disks received on the conveyer belt; and a receptacle for accepting disks.

In accordance with another aspect of the present invention, a method of printing indicia on a disk includes the steps of placing a disk on a conveyor belt assembly for receiving a disk; conveying the disk from a first position to a second position, the conveyor belt assembly having at least one pocket for accepting a disk; and marking indicia on the disks received on the conveyer belt.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

This invention provides a system and method for marking indicia on a markable medium including optical media, such as compact disks, CD-Rs, CD-RWs, digital video disks or digital versatile disks, computer chips, paper products, and paper like products. The system and method provide for the marking of a large number of media in an efficient and expedient manner. The in-line marking system may be used as part of or in conjunction with systems for handling, printing, duplicating or replicating of markable mediums.

Figure 1:
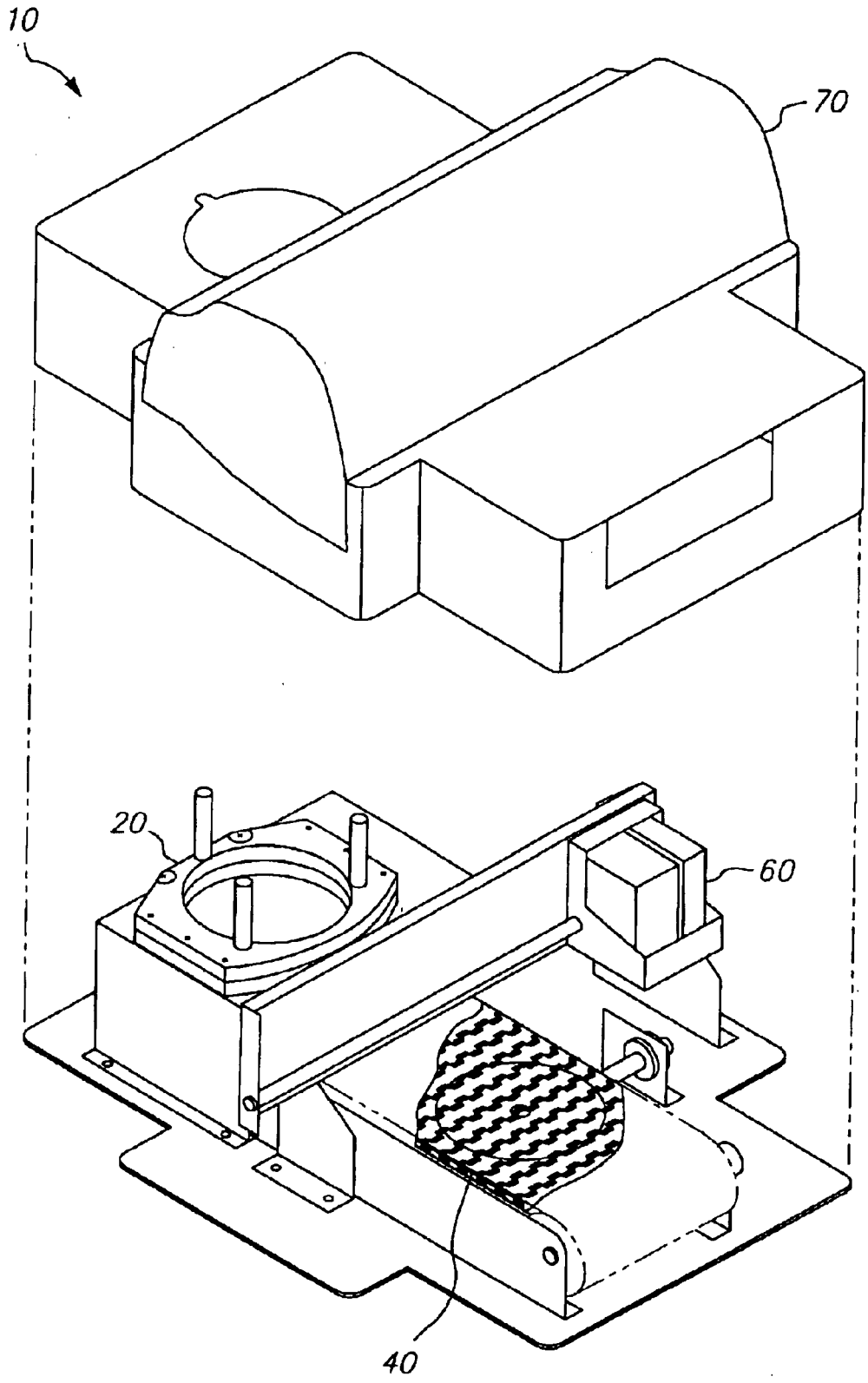
FIG. 1 is a perspective view of an in-line marking system in accordance with the present invention.

FIG. 1 shows an in-line marking system, generally designated with the reference numeral 10. The system 10 includes a dispenser 20, a conveyor belt assembly 40, and a marking device 60. The system 10 may also include a protective cover 70.

Figure 2:
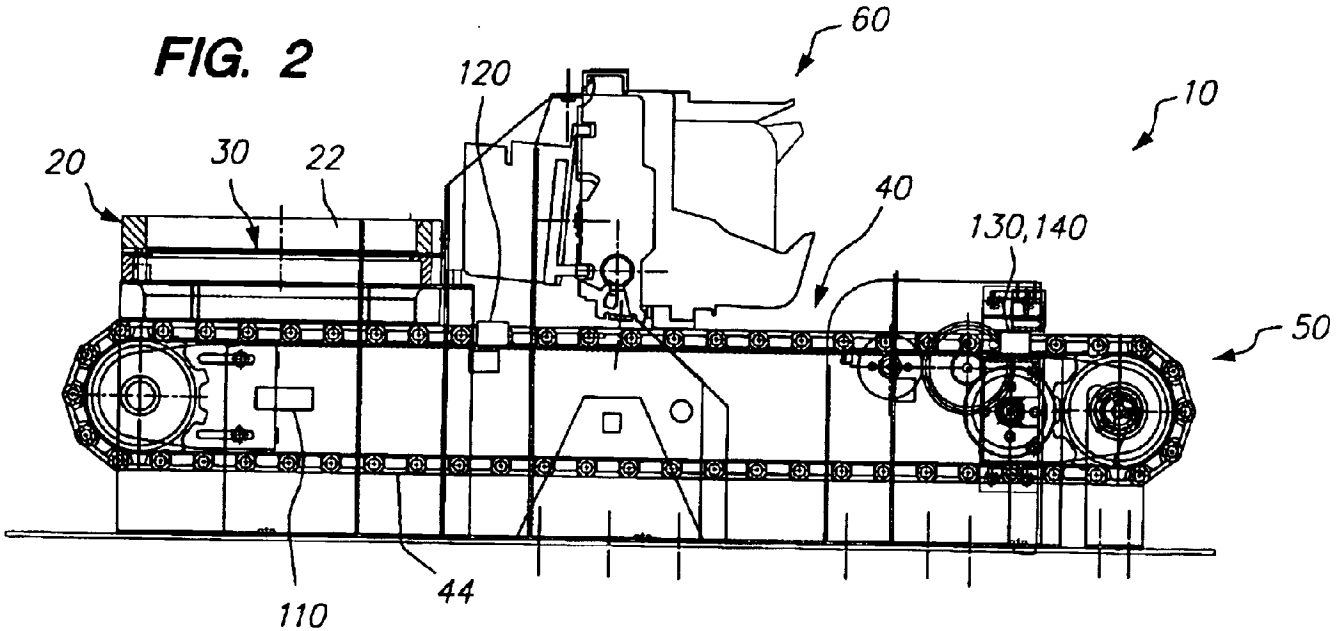
FIG. 2 is a side elevation view of the in-line marking system of FIG. 1.

FIG. 2 shows a side elevation view of the in-line marking system 10 of FIG. 1. The dispenser 20 dispenses a markable medium 30 onto the conveyor belt assembly 40. The dispenser 20 has a hopper 22 for holding the medium 30. The dispenser 20 is located over the conveyor belt assembly 40 such that the medium 30 is individually dispensed onto the conveyor belt assembly 40. The dispenser 20 dispenses the medium 30 at a predetermined interval or alternatively, the medium 30 can be dispensed at variable intervals. The rate of dispensing the medium 30 is controlled by a plurality of sensors 110, 120, 130, and 140 located within the inline marking system 10.

In one embodiment, the dispenser 20 is a disk dispenser as described in Wolfer et al., U.S. Pat. No. 6,135,316, which is incorporated herein by reference in its entirety. The dispenser 20 as disclosed in U.S. Pat. No. 6,135,316, dispenses disks from the bottom of a stack of disks having an upper guide, a lower guide and a plate slidably mounted between the upper guide and the lower guide. The upper guide and lower guide define an opening, wherein the plate slides to dispense disks through the lower guide opening. However, it can be appreciated that the dispenser 20 can use pick and place technology or any other known method for dispensing a disk or medium 30 onto a conveyor belt 44.

In a preferred embodiment, the markable medium 30 includes optical disks or magnetic memory storage media including compact disks, CD-Rs, CD-RWs, digital video disks or digital versatile disks, and the like. However, as will be recognized by one skilled in the art and as set forth above, the markable medium 30 can be of any desired type and is not limited by the size or shape of the medium.

The dispenser 20 of the present invention is also useful in conjunction with printing or marking on memory storage disks such as compact disks, and duplicating compact disks. It can be appreciated, however, that a variety of media including optical or magnetic memory storage media may be dispensed and marked or duplicated in accordance with the present invention. Preferably, the dispenser 20 holds between 10 and 50 mediums depending on the type and nature of the medium 30 to be dispensed.

The conveyor belt assembly 40 includes a conveyor belt 44 having a plurality of pockets 42 for receiving the medium 30 from the dispenser 20, and a chassis assembly 50.

Figure 3:
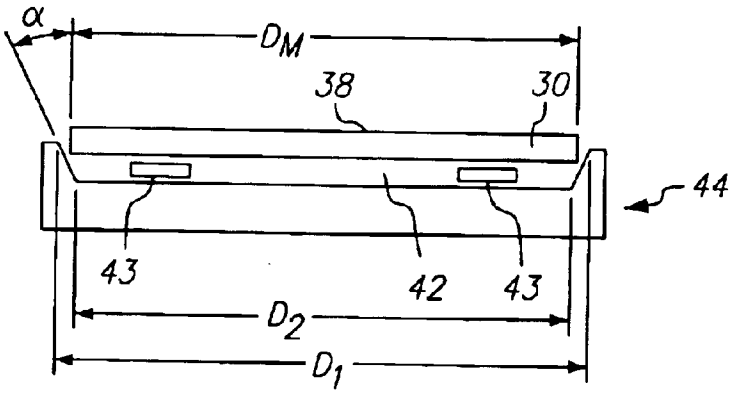
FIG. 3 is a cross sectional view of the conveyor belt of the in-line system of FIG. 1.

FIG. 3 shows a cross-sectional view of the pocket 42 in the conveyor belt 44. The pocket 42 for a circular medium has a first diameter $D_1$ and a second diameter $D_2$ for accepting the medium 30. The first diameter $D_1$ is greater than the second diameter $D_2$ which allows the medium 30 to fit firmly in the pocket 42 of the conveyor belt 44. In a preferred embodiment, a wall 46 between the first diameter $D_1$ and the second diameter $D_2$ forms a first angle $\alpha$ of about 15 degrees with a line perpendicular to the convey belt 44. It can be appreciated, however, that the first angle $\alpha$ can be between about 1 degree to about 60 degrees.

In operation, the medium 30 will preferably have a diameter $D_M$, wherein the first diameter $D_1$ of the pocket 42 will be slightly larger than the diameter $D_M$ of the medium 30. Meanwhile, the second diameter $D_2$ will be slightly smaller than the diameter $D_M$ of the medium 30. Thus, when the medium 30 is dispensed onto conveyor belt 44, the medium 30 will rest firmly within the pocket 42. The pocket 42 will have various depths depending on the type and thickness of medium 30. However, a marking surface 38 of the medium 30 will preferably be even to about 0.05 inches above a surface 48 of the conveyor belt 44 which will allow for optimal marking by the marking device 60. The marking surface 38, however, can be between about 0.001 inches and about 0.5 inches above the surface 48 of the conveyor belt 44. The firm fit ensures the application of a uniform pressure against the medium 30 during the marking process.

In another embodiment, a series of pads 43 will be placed at the bottom of the pocket 42 of the conveyor belt assembly 40. The series of pads 43 in combination with the pocket 42 having a first diameter $D_1$ and a second diameter $D_2$ ensures that the medium 30 fits firmly in the pocket 42. It can be appreciated that the pads 43 can be rubber, foam, or any other type of material which cushions the pocket 42.

In a preferred embodiment, the pocket 42 will be machined into the conveyor belt 44. However, it can be appreciated that the pocket 42 can be molded or manufactured in any known method to one skilled in the art depending on the type of material used for the conveyor belt 44.

For example, in one embodiment of the in-line marking system 10 for use with optical disk such as CD-ROM, the pocket 42 is machined into the conveyor belt 44. The pocket will preferably have a first diameter $D_1$ of about 4.715 inches and a second diameter $D_2$ of about 4.745 inches, with a depth of about 0.05 of an inch for a standard 4.72 inch disk. Alternatively, in another embodiment, the pocket 42 has a first diameter $D_1$ of about 3.475 inches and a second diameter $D_1$ of about 3.525 with a depth of about 0.05 inches for a 3.5 inch disk. In addition, the pocket 42 will preferably have a first angle $\alpha$ of about 15 degrees for accepting the disk. However, it can be appreciated that the first angle $\alpha$ can be anywhere between about 1 degree and about 60 degrees.

Figure 4:
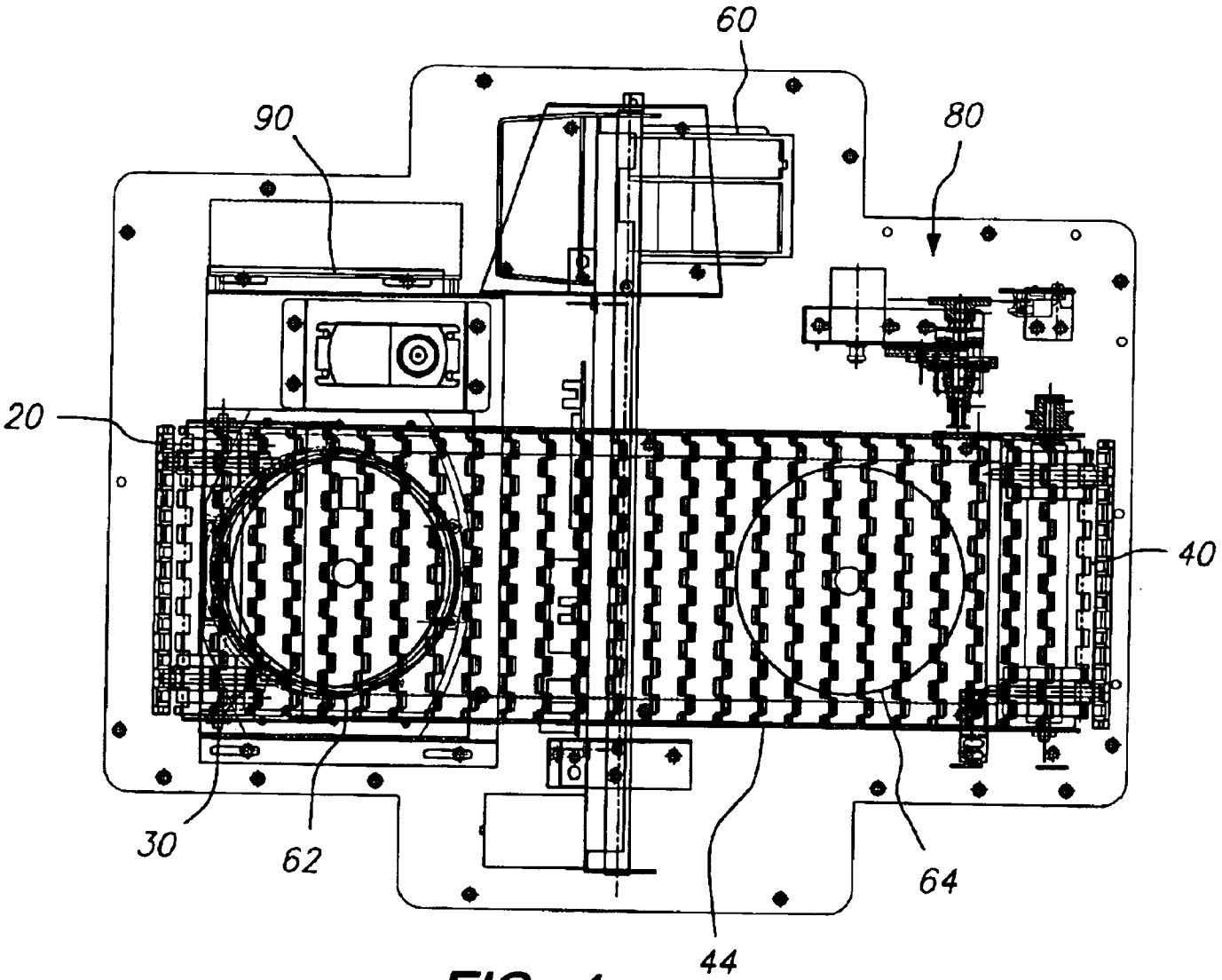
FIG. 4 is a top view of the in-line marking system of FIG. 1.

As shown in FIG. 4, the conveyor belt assembly 40 conveys the medium 30 from a first position 62 to a second position 64. Further movement of the conveyor belt assembly 40 enables the dispenser 20 to dispense another medium 30 onto the conveyor belt 44. The conveyor belt 44 is preferably made of plastic, however, it can be appreciated that the conveyor belt 44 can be made of nylon, rubber, metal, or any other material which will provide the characteristics necessary to allow the marking device 60 to mark the medium 30 without affecting the quality of the marking process.

Figure 5:
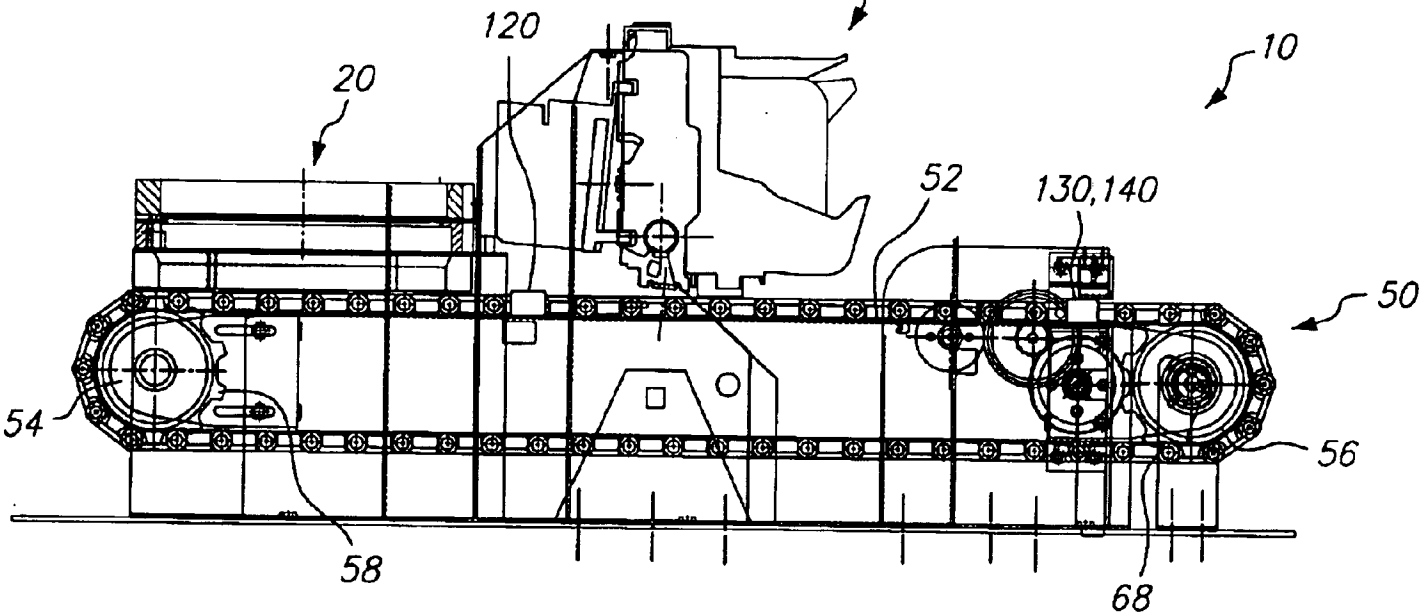
FIG. 5 is a side elevation view of a chassis assembly of the in-line marking system.

The chassis assembly 50 as shown in FIG. 5, includes a support frame 52, a first roller 54 and a second roller 56. The support frame 52 is located between the first roller 54 and the second roller 56. The conveyor belt 44 preferably will lay flat on top of the support frame 52 of the chassis assembly 50, which ensures a stable and uniform marking process.

The chassis assembly 50 preferably has a length of between about 12 inches and about 72 inches, and a width of between about 4 inches to about 12 inches. Meanwhile, the conveyor belt 44 preferably has a length of between about 24 inches and about 144 inches, and a diameter of about 4 inches to about 12 inches.

The first roller 54 is located nearest the dispenser 20 and is preferably a free wheel having a plurality of spokes 58. However, it can be appreciated that the first roller can also be a fly wheel or balance wheel. The first roller 54 rotates with the movement of the conveyor belt 44.

Figure 6:
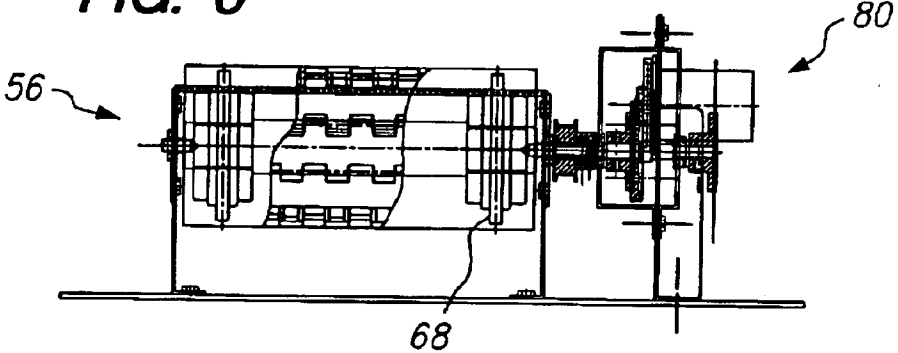
FIG. 6 is an end elevation view of the conveyor belt assembly of the in-line marking system.

The second roller 56 is located nearest the marking device 60 and is driven by the motor 80. The second roller 56 is preferably a fly wheel, however, it can be appreciated that the second roller 56 can be a balance wheel, or any other type of wheel driven by a motor 80. As shown in FIG. 6, the second roller 56 has a plurality of spokes 68 which controls the movement and rotation of the conveyor belt 44. In a preferred embodiment, the motor 80 imparts a uniform rotational velocity to the second roller 56.

Figure 7:
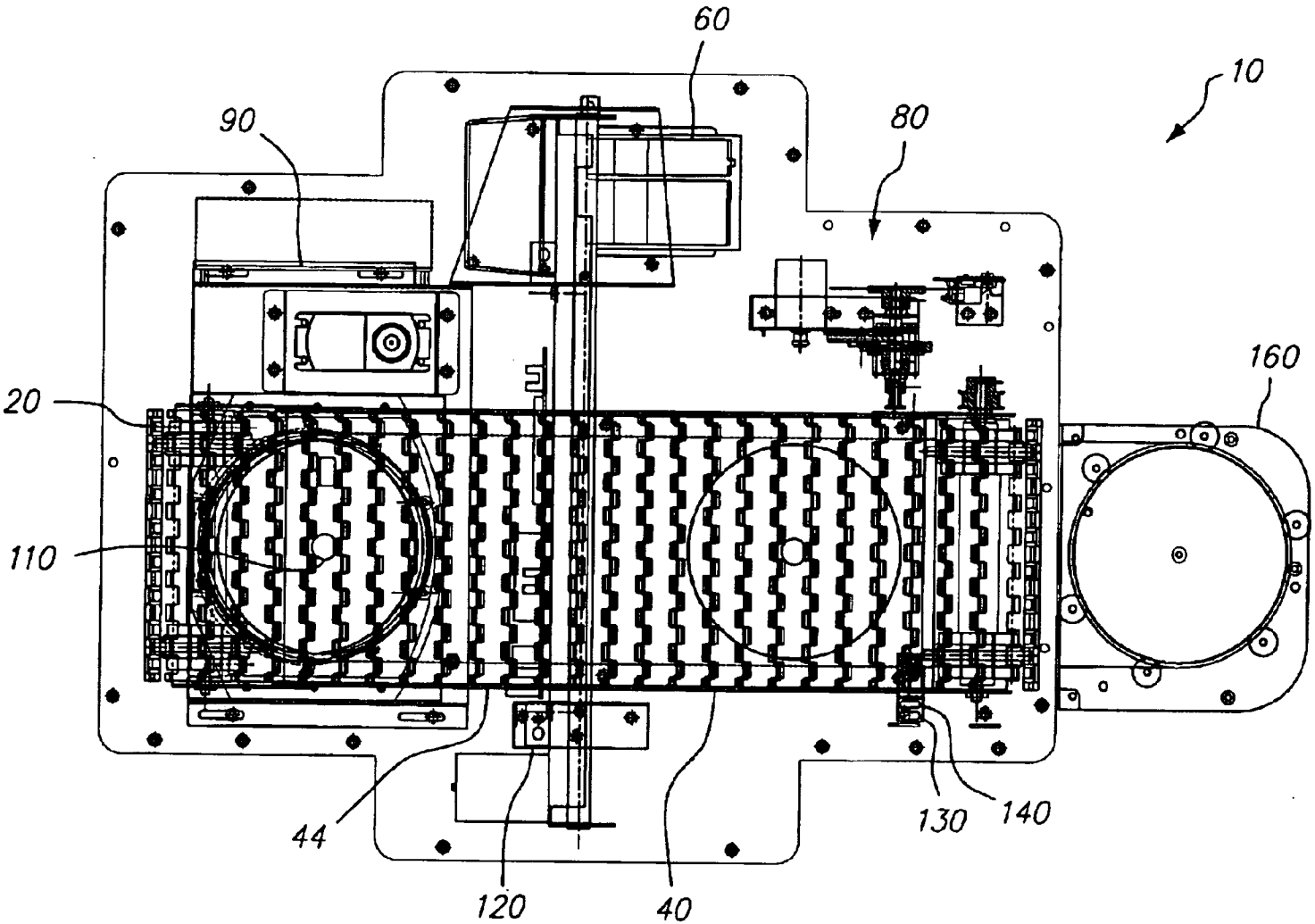
FIG. 7 is a top view of the in-line marking system.

FIG. 7 shows a top view of the in-line marking system 10 of FIG. 1. The in-line marking system 10 includes the disk dispenser 20, the conveyor belt assembly 40, the marking device 60, a motor 80, a microprocessor or loader board 90, and a plurality of sensors 110, 120, 130 and 140, and a receptacle 160.

The marking device 60 is located between the first position 62 and the second position 64 of the in-line marking system 10. The marking device 60 is located above the conveyor belt assembly 40 and marks indicia 32 on the medium 30. The indicia 32 can include logos, trademarks, graphics, text, and bar codes related to the information stored on the medium. However, it can be appreciated that marking device 60 can include a duplicating and replicating device for multiple copies of the medium. For example, with optical disks, as will be recognized by one skilled in the art, the marking device could include a disk writer or any other known optical disk duplicator.

Generally, a marking device 60 for printing information and graphics on the surface of a medium 30, particularly compact disks, will include one or more of the following devices or printing processes: a silk screening printer, a printer utilizing ink jet printing technology, a labeling process or a thermal printing process. The marking device 60 is preferably interchangeable, such that more than one type of marking device 60 can be used with each in-line marking system 10. For example, the marking device 60 is preferably interchangeable such that it will accommodate a print engine, or a duplicator. Alternatively, the system can be designed for a single marking device. However, in any marking device 60, it is desirable that the pressure against the medium be uniformly applied during the marking (or printing) process in order to insure the highest quality of marking onto the medium.

In addition, it can be appreciated that any commercial available print engine, such as those manufactured by Lexmark, Hewlett-Packard or Compaq can be used as a marking device 60. The indicia 32 information will preferably be delivered to the marking device 60, via a computer or microprocessor, such as a commercially available Pentium-type processor or any other known processor. According to one variation of the invention, the marking device 60 is a CD printer for printing indicia on disk surfaces and the dispenser 20 dispenses disks to the CD printer.

The motor 80 drives the conveyor belt assembly 40 by rotating in short and essentially uniform angular movements. The motor 80 is attached to the second roller 56 and controls the speed of the conveyor belt 44. The speed of the conveyor belt 44 and the marking device 60 should be equal, which allows the marking device 60 to mark the medium 30 in one continuous movement. The marking device 60 marks the medium 30 as the medium 30 moves past the marking device 60. Thus, this avoids the necessity of having to stop and start the conveyor belt assembly 40 for each and every medium 30 that is marked. In a preferred embodiment, the motor 80 is a gear reduced, DC motor. However, it can be appreciated that the motor 80 can also be a magnetic stepper motor, a stepper motor, or step-servo motor.

The loader board 90 controls the dispenser 20, conveyor belt assembly 40, marking device 60, motor 80, and sensors 110, 120, 130, and 140. The loader board 90 (or microprocessor) is located within the in-line marking system 10 and directs the marking process. The primary function of the loader board 90 is to control the dispensing of the medium 30 by the dispenser 20. However, the loader board 90 is also in communication with the plurality of sensors 110, 120, 130 and 140, wherein the sensors 110, 120, 130 and 140 assist the loader board 90 with dispensing the media 30 onto the conveyor belt 44. The sensors 110, 120, 130 and 140 also assist with the operation of the marking device 60.

In operation, the loader board 90 receives a signal from the plurality of sensors 110, 120, 130, and 140, each located on or near the conveyor belt assembly 40. Each of the sensors 110, 120, 130, and 140 receive and emit a plurality of signals which are then communicated to the loader board 90, which directs the marking process.

The first of a plurality of sensors, sensor 110 is located underneath the dispenser 20 below conveyor belt 44 and chassis 50. The sensor 110 senses the presence of the medium 30 in the pocket 42 of the conveyor belt assembly 40 and communicates the presence of the medium 30 to the loader boarder 90. The loader board 90 then directs the motor 80 to advance the second roller 58. The second roller 58 rotates causing the conveyor belt 44 to move forward and advances the medium 30 toward the marking device 60. The first sensor is preferably an optical proximity sensor. However, it can be appreciated that the first sensor 110 can be any type of sensor including microswitches, capacitative sensors, inductive sensors, magnetic read switches, etc. which recognizes the presence of the medium 30 within the pocket 42 of the conveyor belt assembly 40.

Figure 8:
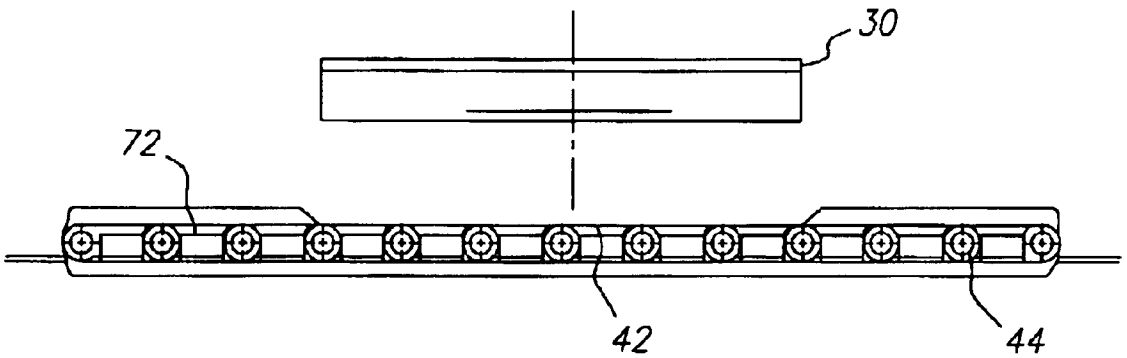
FIG. 8 is a side elevation view of the conveyor belt assembly of the in-line marking system.

The second sensor 120 is located on the side of the conveyor belt assembly 40 between the first sensor 110 and the marking device 60. In the conveyor belt assembly 40, as shown in FIG. 8, a plurality of markings 72 on an edge of the conveyor belt 44 identifies each of the pockets 42 in the conveyor belt assembly 40. The marking 72 allows for the alignment of the dispenser 20 with the pocket 42 of the conveyor belt assembly 40. In operation, the second sensor 120 senses the marking 72 on the edge of the conveyor belt 44 and aligns the conveyor belt assembly 40 with the dispenser 20. Once the pocket 42 of the conveyor belt assembly 44 is aligned with the dispenser 20, the dispenser 20 dispenses the medium 30 onto the pocket 42 of the conveyor belt assembly 40. The second sensor 110 is optional, such that the system 10 can be designed without the second sensor 110.

The third sensor 130 is also located on the side of the conveyor belt assembly 40 and signals the beginning of the marking process. The third sensor 130 senses the marking 72 on the edge of the conveyor belt 44 as the medium 30 arrives at the marking device 60. The third sensor 130 sends a signal to the loader board 90 which communicates with the marking device 60 to begin the marking process.

The fourth sensor 140 is located on the side of the conveyor belt assembly 40 and signals the end of the marking process. Once the marking process has been completed, the fourth sensor 140 senses the marking 72 on the edge of the conveyor belt 44 as the medium 30 completes the marking process. The fourth sensor 140 signals the loader board 90 that the marking process has been completed and to advance the medium 30 slightly forward.

The second, third and fourth sensors 120, 130 and 140 are preferably optical proximity sensors, however, it can be appreciated that the sensors may be an optical sensor, or any device that senses either the absolute value or a change in a physical quantity such as light, or radio waves and converts that change into a useful input signal for an information-gathering system.

In an alternative embodiment, the sensors 110, 120, 130 and 140 are optical sensors which detect the presence of a hole or gap in the conveyor belt 44. For example, in one embodiment of the present invention, rather than a marking 72 on the edge of the conveyor belt 44, the conveyor belt 44 has a hole or gap in the side of the conveyor belt assembly 40 which the optical sensor senses for controlling the movement of the conveyor belt 44 and the medium 30 throughout the marking process.

Based on the location of the medium 30, the loader board 90 sends a signal to the motor 80 to advance the conveyor belt assembly 40. As the conveyor belt assembly 40 advances, the loader board 90 receives a series of signals from the sensors 110, 120, 130, and 140. The loader board 90 sends a signal to the dispenser 20 to release another medium 30 onto the conveyor belt assembly 40. The loader board 90 controls the movement of the conveyor belt 44 such that the medium 30 is dispensed onto pocket 42 of the conveyor belt assembly 40 at the correct intervals. After the marking of indicia 32 onto the medium 30 by the marking device 60 is completed, the loader board 90 sends a signal to the motor 80 to either continue with the marking process or cease operation.

FIG. 8 is a side view of the pocket 42 in the conveyor belt 44 showing the pocket 42 for receiving the medium 30. Since the medium 30 can include optical disks which are circular in shape, computer chips which are rectangular, or any paper product or like material including plastics, rubber, metal, or nylon which have a variety of shapes, the shape of the pocket 42 can vary accordingly. In addition, to the shape of the pocket 42, the depth of the pocket 42 will vary depending on the medium 30. The markings 72 on the side of the conveyor belt 44 identifies each pocket 42 for alignment of the conveyor belt assembly 40 with the dispenser 20.

Figure 9:
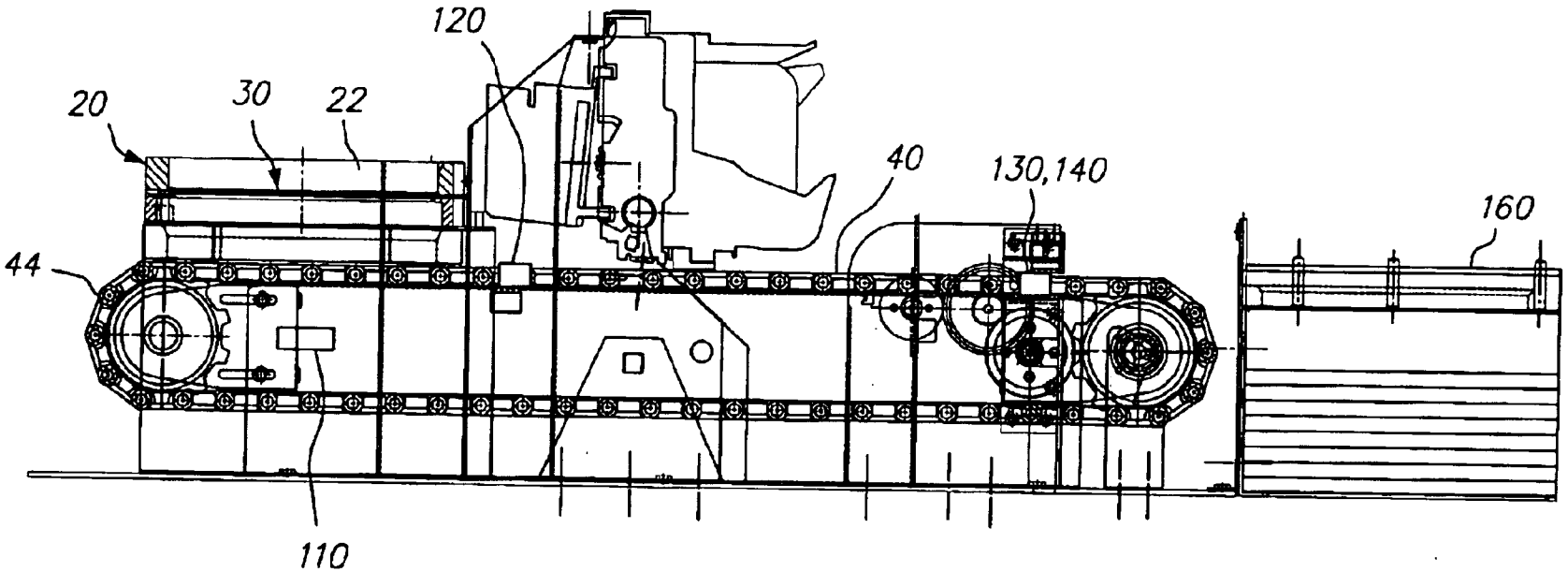
FIG. 9 is a side elevation view of the in-line marking system and receptacle.

In another embodiment, as shown in FIG. 9, the in-line marking system has a receptacle 160 for receiving the medium 30 after marking the medium 30 with indicia 32. The receptacle 160 can be an upstacker as disclosed in Wolfer et al., U.S. Pat. No. 6,337,842, and U.S. patent application Ser. No. 09/828,569, which are incorporated herein by reference in their entirety. However, it can be appreciated that the receptacle could be a basket, a hopper with a spring loaded basket, or any other suitable device for receiving the medium 30 from the conveyor belt assembly 40.

Figure 10:
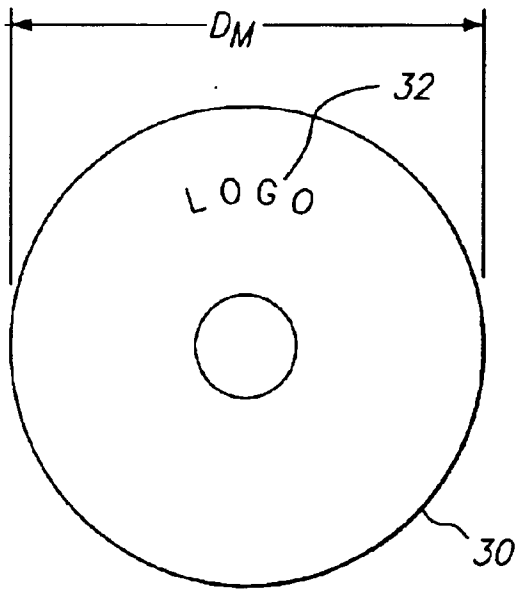
FIG. 10 is a top view of an optical disk for use with the in-line marking system.

FIG. 10 shows a circular medium 30 having indicia 32 marked on a top surface 38 of the medium 30. In one embodiment, the medium 30 has a diameter $D_M$ which is slightly smaller than the first diameter $D_1$ of the pocket 42. The diameter $D_M$, however, will be slightly larger than the second diameter $D_2$ of the pocket 42 which will allow the medium 30 to rest firmly in the pocket 42.

The in-line marking system may be configured to be a stand-alone printer integrated into a reading and recording device, or combined with any other known marking device.

Figure 11:
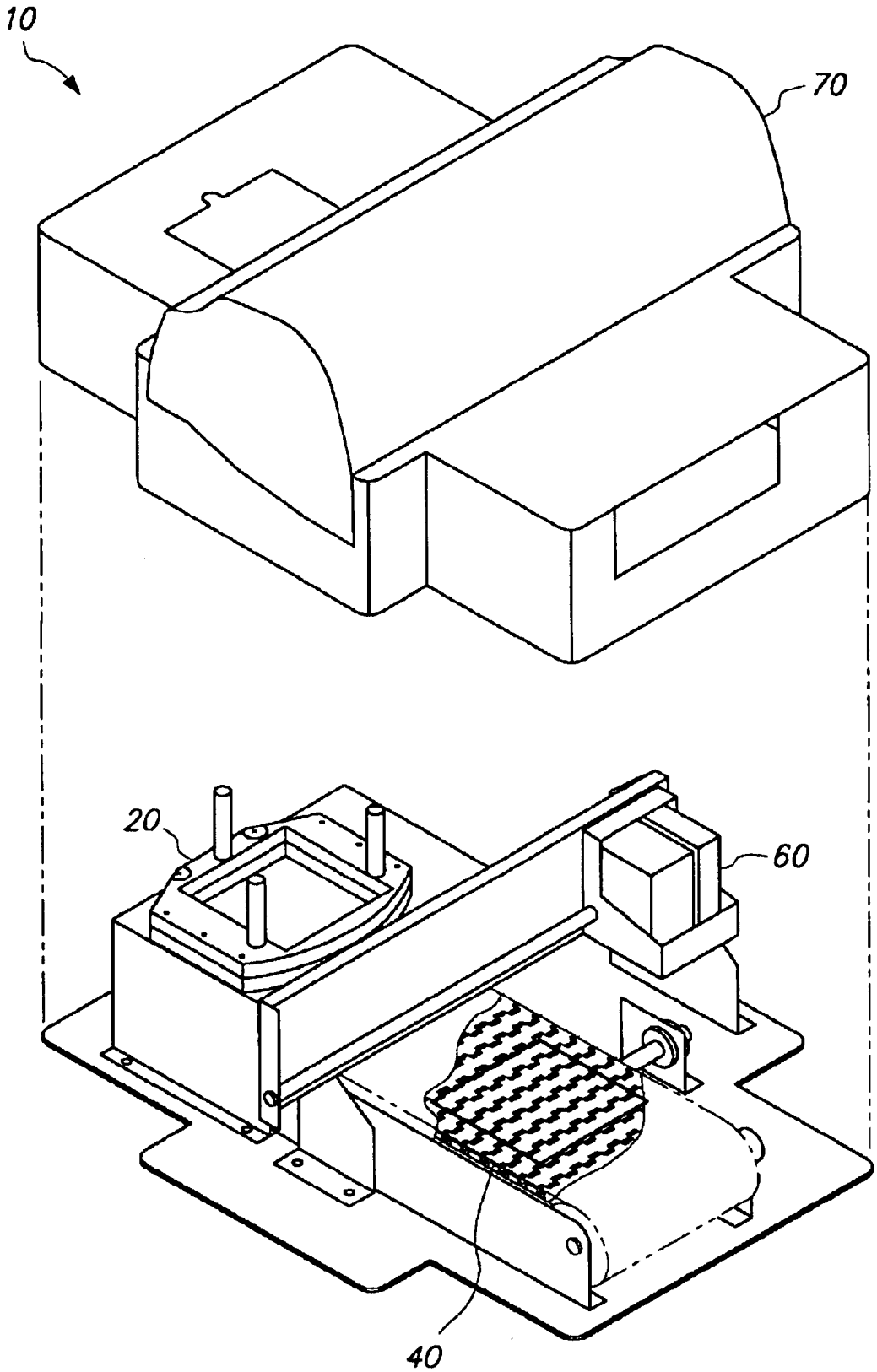
FIG. 11 is a perspective view of the in-line marking system in accordance with the present invention having a rectangular pocket.

FIG. 11 shows a perspective view of the in-line marking system 10 having a rectangular pocket 170.

Figure 12:
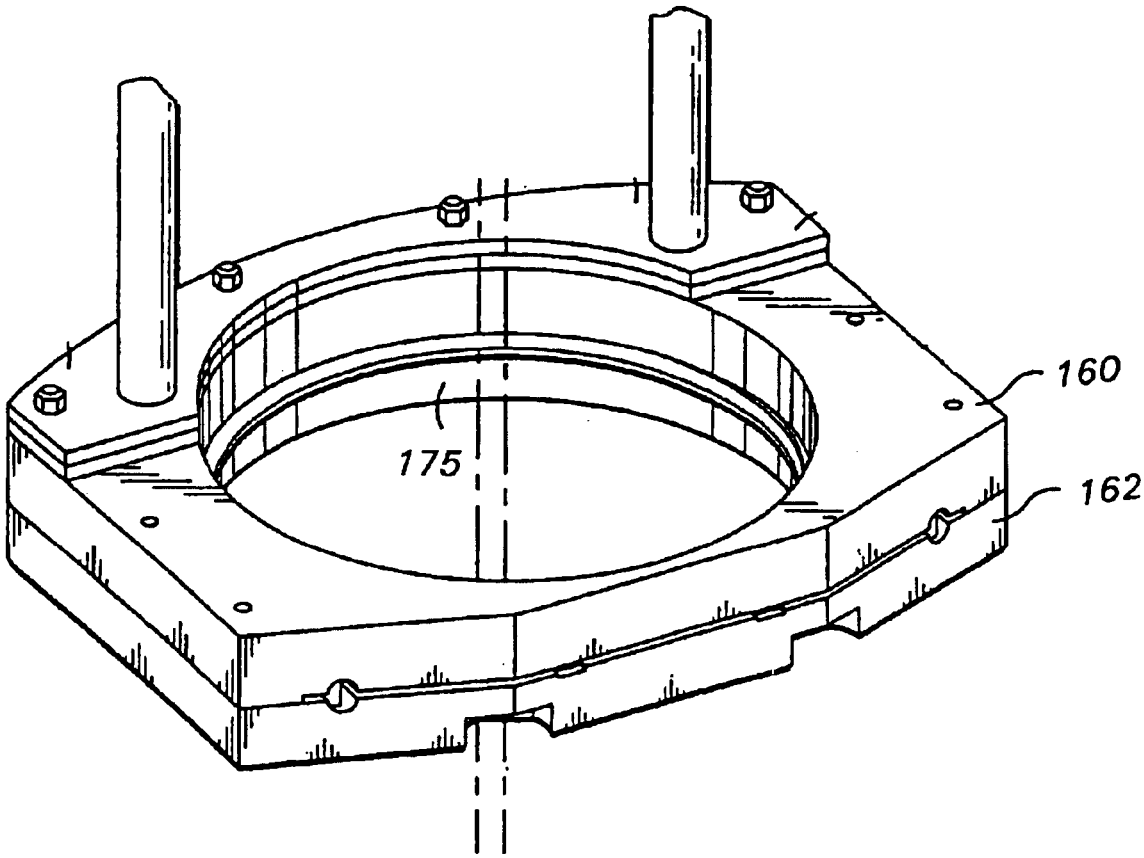
FIG. 12 is a perspective view of a dispenser in accordance with the present invention.

FIG. 12 shows a perspective view of a disk dispenser according to the present invention. The disk dispenser includes an upper guide 160, a lower guide 162 and a plate 175 slidably mounted between the upper guide 160 and the lower guide 162. The upper guide 160 and lower guide 162 define an opening, wherein the plate 175 slides to dispense disks through the lower guide opening.

While the invention has been described in detail with reference to the preferred embodiments thereof, it will be apparent to one skilled in the art that various changes and modifications can be made and equivalents employed, without departing from the present invention.

What is claimed is:

1. An in-line marking system comprising:

a dispenser for dispensing a markable medium;

a conveyor belt assembly for receiving the medium and passing the medium from a first position to a second position, the conveyor belt assembly having a plurality of pockets for accepting the medium;

a marking device located between the first position and the second position for marking indicia on the medium; and a first sensor configured to align the plurality of pockets of the conveyor belt assembly with the dispenser, wherein the dispenser dispenses the medium from a bottom of a stack of mediums and onto the conveyor belt assembly.

2. The system according to claim 1, wherein the pockets have a first diameter and a second diameter.

3. The system according to claim 2, wherein the first diameter of the pocket is greater than the second diameter of the pocket.

4. The system according to claim 1, wherein the pockets have an outer wall which is angled with respect to a line perpendicular to a surface of the conveyor belt.

5. The system according to claim 1, wherein the pockets are circular.

6. The system according to claim 1, wherein the pockets are rectangular.

7. The system according to claim 1, wherein the marking device is an ink jet printer.

8. The system according to claim 1, further comprising a receptacle for accepting the medium after marking.

9. The system according to claim 8, wherein the receptacle is a hopper with a spring loaded basket.

10. The system according to claim 1, wherein the medium is an optical disk.

11. The system according to claim 1, wherein the medium is a digital medium.

12. The system according to claim 1, wherein the in-line marking system is a stand-alone printer.

13. The system according to claim 1, wherein the in-line marking system is integrated into a reading and recording device.

14. The system according to claim 1, wherein the plurality of pockets are recesses in a surface of the conveyor belt configured to receive and secure the markable medium.

15. The system according to claim 1, wherein the dispenser has an upper guide, a lower guide, and a plate slidably mounted between the upper guide and lower guide for dispensing the medium from the stack of mediums.

16. The system according to claim 1, further comprising a second sensor configured to sense the presence of the medium in the pocket of the conveyor belt assembly.

17. The system according to claim 16, further comprising a third sensor configured to begin the marking of indicia on the medium.

18. The system according to claim 17, further comprising a fourth sensor configured to signal an end to the marking of indicia on the medium.

19. A disk transfer system comprising:

a disk dispenser for dispensing disks;

a conveyor belt assembly for receiving a disk and passing the disk from a first position to a second position, the conveyor belt assembly having a plurality of pockets for accepting a disk;

a marking device located between the first position and the second position for marking indicia on the disk; and a first sensor configured to align the plurality of pockets of the conveyor belt assembly with the dispenser, wherein the dispenser dispenses the disk from a bottom of a stack of disks and onto the conveyor belt assembly.

20. The disk transfer system according to claim 19, wherein the pockets have a first diameter and a second diameter.

21. The disk transfer system according to claim 19, wherein the first diameter of the pocket is greater than the second diameter of the pocket.

22. The disk transfer system according to claim 19, wherein the pockets are circular.

23. The disk transfer system according to claim 19, wherein the marking device is an ink jet printer.

24. The disk transfer system according to claim 19, wherein the marking device is a data writer.

25. The disk transfer system according to claim 19, further comprising a receptacle for accepting disks.

26. The disk transfer system according to claim 25, wherein the receptacle is a hopper with a spring loaded basket.

27. The system according to claim 19, wherein the dispenser has an upper guide, a lower guide, and a plate slidably mounted between the upper guide and lower guide for dispensing the disk from the stack of disks.

28. The system according to claim 19, further comprising a second sensor configured to sense the presence of the disk in the pocket of the conveyor belt assembly.

29. The system according to claim 28, further comprising a third sensor configured to begin the marking of indicia on the disk.

30. The system according to claim 29, further comprising a fourth sensor configured to signal an end to the marking of indicia on the disk.

31. A disk transfer system comprising:

a disk dispenser for dispensing a disk from a stack of disks;

a conveyor belt assembly for receiving the disk from the disk dispenser and passing the disk from a first position to a second position, the conveyor belt assembly having a plurality of pockets for accepting a disk;

a marking device located between the first position and the second position for marking indicia on the disks received on the conveyer belt;

a first sensor configured to align the plurality of pockets of the conveyor belt assembly with the dispenser; and a receptacle for accepting disks.

32. The system according to claim 31, wherein the dispenser has an upper guide, a lower guide, and a plate slidably mounted between the upper guide and lower guide for dispensing the disk from the stack of disks.

33. The system according to claim 31, further comprising a second sensor configured to sense the presence of the disk in the pocket of the conveyor belt assembly.

34. The system according to claim 33, further comprising a third sensor configured to begin the marking of indicia on the disk.

35. The system according to claim 34, further comprising a fourth sensor configured to signal an end to the marking of indicia on the disk.

36. A method of printing indicia on a disk, the method comprising:

dispensing a disk from a stack of disks and onto a conveyor belt assembly;

conveying the disk from a first position to a second position, the conveyor belt assembly having at least one pocket for accepting a disk, wherein the dispensing of the disk from the stack of disks is controlled by a first sensor configured to align the plurality of pockets of the conveyor belt assembly with the stack of disks; and marking indicia on the disks received on the conveyer belt.

37. The method of printing indicia on a disk according to claim 36, further comprising a disk dispenser for dispensing the disk onto the conveyor belt.

* * * * *